United States Patent [19]

Didchenko et al.

[11] Patent Number: 4,762,608

[45] **Date of Patent: * Aug. 9, 1988**

[54] UPGRADING OF PYROLYSIS TAR

[75] Inventors: Rostislav Didchenko, Middleburg Heights; Eric M. Dickinson, Bay Village, both of Ohio

[73] Assignee: Union Carbide Corporation, Danbury, Conn.

[ * ] Notice: The portion of the term of this patent subsequent to Apr. 26, 2005 has been disclaimed.

[21] Appl. No.: 684,140

[22] Filed: Dec. 20, 1984

[51] Int. Cl.[4] ..... C10G 45/00

[52] U.S. Cl. ..... 208/89; 208/44; 208/50; 208/111; 208/131; 208/57

[58] Field of Search ..... 208/44, 50, 89, 111, 208/131, 57

[56] References Cited

U.S. PATENT DOCUMENTS

| | | | |
|---|---|---|---|
| 3,773,653 | 11/1973 | Nongbri et al. | 208/50 |
| 3,817,853 | 6/1974 | Folkins | 208/50 |
| 4,178,229 | 12/1979 | McConaghy et al. | 208/50 |
| 4,213,846 | 7/1980 | Sooter et al. | 208/50 |
| 4,235,703 | 11/1980 | Kegler et al. | 208/89 |
| 4,312,742 | 1/1982 | Hayashi | 208/50 |
| 4,358,366 | 11/1982 | Alford et al. | 208/50 |
| 4,394,250 | 7/1983 | Grossberg | 208/111 |
| 4,419,271 | 12/1983 | Ward | 502/66 |
| 4,466,883 | 8/1984 | Eickmeyer et al. | 208/89 |

*Primary Examiner*—H. M. S. Sneed
*Assistant Examiner*—Helane Myers
*Attorney, Agent, or Firm*—James L. Sonntag

[57] ABSTRACT

Pyrolysis tars are upgraded by hydrotreatment in the presence of a catalyst having a hydrogenation component and an acidic component. The treated pyrolysis tars are used to produce premium cokes useful in the production of graphite electrodes.

15 Claims, No Drawings

UPGRADING OF PYROLYSIS TAR

This application is related to concurrently filed U.S. Application Ser. No. 684,139 pending, by E. Dickinson, and R. Didchenko.

FIELD OF THE INVENTION

The invention relates to the production of premium coke suitable for use in the production of graphite electrodes, particularly to a process for producing a premium coke from pyrolysis tar.

More particularly the invention relates to the upgrading of pyrolysis tar under hydrotreatment conditions using a catalyst with an acidic component and a hydrogenation component, such that the pyrolysis tar can be used to produce a premium coke.

BACKGROUND OF THE INVENTION

Premium coke is well known in the art and is a commercial grade of coke having acicular, and anisotropic microstructure.

Premium cokes are used in the production of electrode grade graphite which requires that the coke have certain qualities. For example, a graphite electrode to be used in the arc melting of steel or the like must possess a low value for the coefficient of thermal expansion (CTE), particularly in the longitudinal direction, because of the severe thermal shocks which occur in such processes. The premium coke used for producing the graphite electrode must be capable of imparting a low CTE to the electrode.

In the process for producing a graphite electrode, a carbon body is formed from a coke and the carbon body is heated to between about 2000° C. and about 3000° C. to convert the carbon in the coke to a graphite crystalline form and to volatilize impurities. When a carbon body made from a coke is heated to temperature in the range of from about 1000° C. to about 2000° C., various sulfur-containing compounds present in the coke decompose, which often results in a rapid expansion and possible breakage of the carbon body. This phenomenon is termed "puffing". It is desirable to use a precursor containing a low amount of sulfur for producing the premium coke in order to minimize or preferably eliminate problems due to "puffing".

Typically, commercially produced premium cokes are made from aromatic, slowly reacting hydrocarbon feedstocks of low sulfur content, such as decant oils from catalytic cracking and tars obtained from the thermal cracking of decant oils and gas oils.

The presently used hydrocarbon feedstocks are satisfactory, but it would be desirable to use pyrolysis tars as feedstocks for producing premium cokes, because pyrolysis tars are relatively inexpensive mixtures of aromatic compounds and most of these tars have a low sulfur content. Generally, large amounts of pyrolysis tars are made as heavy by-products in the steam cracking of petroleum feedstocks to produce monomers, in particular ethylene, for the plastics industry.

Because of the high aromatic content and the low sulfur content, pyrolysis tars would seem to be suitable feedstocks for the formation of premium coke, but in fact they are generally unsuitable. Most pyrolysis tars are highly reactive, which causes problems in the delayed coking process, which is the process generally used to produce premium cokes. In this process the pyrolysis tars have a tendency to convert to coke in the coils of the delayed coker furnace under typical operating conditions. This results in clogging of the furnace, short operating periods, and excessive down time to clean the furnace coils. Another disadvantage is that cokes produced from pyrolysis tars are generally not premium cokes, that is they impart an undesirably high longitudinal CTE to graphite electrodes made therefrom. For these reasons, most pyrolysis tars are unsuitable for the production or premium coke.

H. O. Folkins in U.S. Pat. No. 3,817,753 discloses a method for upgrading pyrolysis tars by treating the pyrolysis tars with hydrogen in the presence of a conventional hydrodesulfurization catalyst. The catalysts are described as having a hydrogenation component on an inert carrier. Pyrolysis tars can be upgraded to some extent by the treatment with hydrogen in a Folkins process, using only a hydrogenation catalyst. However there is an undesirably high consumption of costly hydrogen and large losses in the final yield of coke. Furthermore, as shown in his Table 2, the CTE values for the cokes produced by the pyrolysis tars treated by the Folkins process ($1.58\times10^{-6}$/°C. and above) are unacceptably high for premium coke, which has a CTE below about $0.55\times10^{-6}$/°C.

Hayashi, et al. in U.S. Pat. No. 4,312,742 discloses the treatment of various feedstocks, including pyrolysis tars, with hydrogen in the absence of a catalyst under gradual heating up to 350° C. to 400° C. They show the production of a final coke product with a marginally acceptable CTE ($0.60\times10^{-6}$/°C.). There is no disclosure of the CTE for the starting material or that the pyrolysis tar was upgraded by lowering of the CTE for the coke made from the tar. Furthermore, the process disclosed by Hayashi, et al. involves a gradual heating which would generally be commercially unacceptable because of the process time involved.

It is, therefore, an object of the invention to provide a method for upgrading pyrolysis tars such that they are suitable for the making of premium coke.

It is also an object of the invention to provide a method for the upgrading of pyrolysis tars with a low or negative consumption of hydrogen.

It is also an object of the invention to provide a method for the upgrading of pyrolysis tars without a high loss of the yield of coke.

It is also an object of the invention to provide a method for producing premium coke that imparts a low CTE to a graphite electrode.

SUMMARY OF THE INVENTION

In its broadest aspect, the invention contemplates a method for upgrading a pyrolysis tar used to form coke which comprises hydrotreating a pyrolysis tar feed in the presence of a catalyst having a hydrogenation component and an acidic component with acid activity, such that the catalyst has at least about 65 micromoles of acid sites per gram of catalyst at about 400° C. after calcination of the catalyst at 500° C.

By practice of the invention it is possible to upgrade a pyrolysis tar, that is the coke produced from the treated pyrolysis tar imparts a significantly smaller CTE to a graphite artifact than the coke produced from untreated pyrolysis tar. It is, therefore, possible to produce premium coke, a coke which is capable of forming a graphite artifact with a CTE less than about $0.55\times10^{-6}$/°C., from pyrolysis tar feedstocks which formerly were not acceptable for making a premium coke to be used in the manufacture of graphite electrodes.

Also within contemplation of the invention is a method for producing a premium coke which comprises subjecting the above treated pyrolysis tar to destructive distillation conditions to form a coke.

Without being bound to any theory, it is believed that the acidic component of the catalyst in cooperation with the hydrogenation component results in beneficial rearrangements of the more reactive molecules in the pyrolysis tar, resulting in an upgraded pyrolysis tar, without the above described problems. It is also believed that the rearrangement of the more reactive species lowers the reactivity of the tars to an extent such that the problems of coking in the coils of delayed coking furnaces are alleviated.

Although a hydrogenation element is present and some hydrogenation of the pyrolysis tar does occur, the method of the invention is essentially not a hydrogentation reaction, as for example in the above Folkins process. It is instead a rearrangement of the molecules. The presence of the acid component of the catalyst of the invention promotes the dehydrogenation or aromatization of hydroaromatic rings in addition to causing molecular rearrangements. During practice of the invention there is little or no consumption of hydrogen, as in a hydrogenation reaction, but hydrogen in some cases may be produced. By the instant method, it is therefore possible to produce material from pyrolysis tar that can be used as a feedstock in the production of premium coke, without the expensive consumption of hydrogen.

In the prior art processes such as that of Folkins, described above, the principle reaction is the addition of hydrogen to the aromatic rings. In addition to the undesirable consumption of hydrogen, the final yield of coke is significantly reduced due to the reduction of the aromatic ring content.

However, in the present method, the molecules are rearranged and the hydrogen redistributed in a manner that does not significantly lower the aromatic ring content, and thus lower the final yield of premium coke to as high a degree.

DESCRIPTION OF THE INVENTION

For purposes of this specification, a "premium coke" is defined as a coke which, after calcination to 1000° C., can be made into a graphite artifact having a CTE in the longitudinal direction not greater than about $0.55\times10^{-6}$/°C. Cokes having a CTE greater than this value are considered not to be premium cokes. The CTE is measured at a temperature in the range from about 30° C. to 100° C.

Pyrolysis tars are residual by-products from olefin plants. In typical processes where pyrolysis tars are produced, petroleum feedstocks, such as naphtha condensates, gas oils, and/or low/boiling hydrocarbons such as ethane and propane, are thermally cracked to produce mainly ethylene, some propylene, and perhaps amounts of butene and acetylene. The cracking is typically carried out at a temperature between about 650° C. and about 980° C. in the presence of a diluent gas, such as steam, at pressures between about 100 and 200 kilopascals. A by-product of these cracking processes are high-boiling point residues, or pyrolysis tars.

Pyrolysis tars useful for upgrading by process of the invention are those which produce non-premium cokes. Pyrolysis tars capable of producing a premium coke are also suitable, although the benefit of upgrading a pyrolysis tar capable of producing a premium coke (lowering the CTE of the carbon artifact made therefrom) is smaller.

Preferably the pyrolysis tars used in the process of the invention have a sulfur content less than about 0.8 weight percent, preferably less that about 0.5 weight percent. Most pyrolysis tars have such low sulfur contents, since the olefin production processes from which they are generally produced usually incorporate feedstock desulfurization treatment.

In the process of the invention, the pyrolysis tar is upgraded by hydrotreating the pyrolysis tar in the presence of a catalyst having an acidic component and also a hydrogenation component. By "hydrotreating" means treatment in the presence of hydrogen at temperature and pressure sufficient to bring about the upgrading of the pyrolysis tar. Typically, the pressure is between about 3.4 and about 13.8 megapascals (500–2000 psi), preferably between about 5.2 and about 10.3 megapascals (750–1500 psi). The temperature is typically between about 260° C. and about 425° C., preferably between about 290° C. and about 370° C.

The method of the invention is carried out in the presence of a catalyst having a hydrogenation component and an acidic component having sufficient acid activity to produce an upgraded pyrolysis tar capable of producing premium coke. When hydrogenation catalysts having no or little acid activity are used, the result is generally excessive consumption of hydrogen. Suitable catalysts are those having an acidic component which imparts to the catalyst an acidity (measured by the number of acid sites) of at least about 65 micromoles of acid sites per gram of the catalyst. The measurement of micromoles of acid sites is made at 400° on samples that have been calcined at 500° C. The total number of acid sites is measured by the ammonia adsorption/TGA method. The ammonia adsorption/TGA method is described in "Solid Acids and Bases", by K. Tanabe, Academic Press, 1970, p. 21.

The acid component of the catalyst can be supplied by known solid acids such as sulfated zirconia, acidic aluminas (e.g., gamma aluminas, and halogenated aluminas), clay-like alumino-silicates and silica-alumina gels, as well as crystalline alumina-silicates (e.g., zeolites). Typically the aluminas and alumino-silicates are steam activated. In general, suitable catalytic solid acids are those providing at least about 65 micromoles of acid sites per gram of catalyst at 400° C.

The hydrogenation element can be supplied by metallic atoms supported upon the catalyst that are commonly used in catalysts for hydrogenation processes. These include the metals, salts, oxides or sulfides of the metals of Groups VIII and VI-B, such as chromium, molybdenum, tungsten, osmium, iridium, platinum, and mixtures thereof. Preferably the hydrogenation component is provided by cobalt, molybdenum, platinum metal or sulfided nickel.

The particular catalyst used is not critical to the invention, but can be any catalyst, which has the defined acid activity and hydrogenation component, such as a catalyst which may normally be used for reforming.

The treated pyrolysis tars from the method of this invention may be transformed into coke by well-known methods of subjecting the pyrolysis tar to elevated temperatures in an oxygen-poor atmosphere to destructively distill off the volatile components. For example, treated pyrolysis tars can be transformed into coke as illustrated in the examples below.

The invention will now be illustrated by the following examples, which are not intended to be limitive of the invention.

The pyrolysis tars in the examples below were formed into coke by heating in a laboratory autoclave at 50° C. per hour to a temperature of 650° C., and maintaining this temperature for 5 hours at a pressure of 100 psig (0.69 megapascals gauge).

The number of acid sites for each catalyst sample was measured using the ammonia adsorption/TGA method at 400° C. using 500° C. calcined samples.

The cokes in each of the examples below were used to produce graphite electrodes in accordance with conventional testing procedures, as follows:

The raw cokes were calcined to 1000° C. and then crushed and milled to a flour such that 55% passed through a 200 mesh Tyler screen. The flour was mixed with coal tar binder pitch and extruded into 19 mm diameter rods and processed into graphite according to standard procedures for forming graphite electrodes. The graphitization was carried out until a temperature of about 3000° C. was reached.

The longitudinal CTE of each rod was measured in the temperature range of from about 30° C. to about 100° C.

Hydrogen volumes given below are at 0° C. and 1 atm. (101 kPa).

EXAMPLE I

This is a comparative example illustrating a process wherein a hydrogenation catalyst with no or negligible acid activity was used in the treatment of pyrolysis tars. The catalyst was similar to those described in the above-cited U.S. Pat. No. 3,817,853 to Folkins and consisted essentially of cobalt and molybdenum on an inert alumina carrier. This catalyst is available commercially from Nalco Chemical Company, Oak Brook, Ill. under the commercial name of Nalco TM 477. This catalyst had a total acidity of about 46 micromoles of acid sites per gram of catalyst at 400° C., as measured by the ammonia adsorption/TGA method. It comprised 5 wt.% CoO, 15 wt.% $MoO_3$, and 80 wt.% gamma-alumina. The bulk density was 0.701 g/cc, the surface area was 250 $m^2/g$, the pore volume was 0.55 cc/g, and the average pore diameter was 90 Angstroms.

The pyrolysis tar (Pyrolysis Tar PT-1) treated was derived from the steam-cracking of a mixture of naphtha and gas oil, and had the properties shown in Table A. Average molecular weight is the number average molecular weight measured by vapor phase osmometry in pyridine at 86° C.

TABLE A

| Properties of Pyrolysis Tar PT-1 | |
|---|---|
| Gravity, °API | −4.7 |
| Average Mol. Wt. | 350.0 |
| Sulfur, Wt. % | 0.26 |
| Carbon, Wt. % | 91.9 |
| Hydrogen, Wt. % | 7.5 |
| Conradson Carbon, Wt. % | 20.0 |
| Initial Boiling Point, °C. | 190.0 |
| 50% Boiling Point, °C. | 410.0 |
| 75% Boiling Point, °C. | 510.0 |

The pyrolysis tar was reacted in the presence of hydrogen over the hydrogenation catalyst in a flow reactor. The reactor was a trickle bed concurrent type and had a volume of 300 cubic centimeters, and contained 100 cubic centimeters of catalyst and 200 cubic centimeters of inert quartz chips. The reaction temperature was about 650° F. (340° C.), the liquid space velocity of the pyrolysis tar was about 1.5 $hour^{-1}$ and the pressure in the reactor was about 1000 psig (6.89 megapascals gauge). Hydrogen was introduced at a rate of 2000 scf/bbl (356 cubic meters of hydrogen per cubic meter of tar feed). Hydrogen consumption was 400 scf/bbl (71 cubic meters of hydrogen per cubic meter of tar feed).

Samples of untreated pyrolysis tar and the hydrotreated pyrolysis tar were coked in a laboratory autoclave as described above, at about 100 psig (0.69 megapascals gauge) with a heating rate of 50° C. per hour to 650° C. with a 5 hour hold at 650° C. The coke was made into electrodes by the above procedure. For both the treated and untreated tar, the coke yield and the CTE of the electrodes made from each coke measured. The results are summarized below in Table B. The coke yield is the wt. percent of the final calcined coke product relative to the weight of the material coked.

TABLE B

| Tar | Treatment With Hydrogenation Catalyst: Coke Yield (%) | CTE ($\times 10^{-6}$/°C.) |
|---|---|---|
| Untreated | 35.6 | 0.61 |
| Treated | 20.7 | 0.49 |

As can be seen, the pyrolysis tar was upgraded by the hydrotreatment, but with a large decrease in coke yield (42 percent), and a high consumption of hydrogen as compared to practice of the invention as illustrated below. As demonstrated by Examples II and IV, below, the high hydrogen consumption, which is inherent in the treatment of pyrolysis tar with hydrogenation catalysts, can be lowered or eliminated by practice of the invention. Furthermore, this example demonstrates how the coke yield can be improved by practice of the invention.

EXAMPLE II

This example illustrates practice of the invention. Pyrolysis Tar PT-1 in Example I was reacted in the presence of hydrogen over a catalyst having both an acid component and a hydrogenation component.

The catalyst was made by loading 4.5 wt.%, CoO, 14.5 wt.% $MoO_3$, and 4.0 wt.% phosphoric acid on blanks comprising 38 wt.% of a silica/alumina, 38 wt.% of a steam activated zeolite and 24 wt.% gamma-alumina. The silica/alumina was a mixture of 25 wt.% silica and 75 wt.% alumina and had a surface area of 400 square meters per gram and pore volume of 0.95 cubic centimeters per gram. The zeolite was a proprietary material known as LZ-10, available from Union Carbide Corporation, Danbury, Ct.

In U.S. Pat. No. 4,419,271, LZ-10 is disclosed as being a modified Y zeolite having a silica to alumina ratio between about 3.5 and 4.0, a surface area between about 500 and 700 square meters per gram, a unit cell size between about 24.25 and 24.35 Angstroms, water adsorption capacity less than about 8 percent by weight of the zeolite (at 4.6 mm partial pressure of water vapor and at 25° C.), and an ion-exchange capacity less than 20% of that of a sodium Y zeolite of comparable silica to alumina ratio.

The catalyst was then calcined in an inert atmosphere by heating the catalyst to a temperature of 220° C., maintaining the temperature at 220° C. for two hours, then heating to a temperature of 550° C., and maintaining the temperature at 550° C. for two hours. The chemical analysis of the catalyst is shown below in Table C.

TABLE C

| Chemical Analysis of Catalyst (Wt. %) | |
|---|---|
| $Al_2O_3$ | 50.06 |
| CoO | 3.61 |
| Mo | 10.10 |
| Fe | 0.11 |
| P | 3.37 |
| $SiO_2$ | 31.65 |

In this catalyst the hydrogenation component was provided by the cobalt and molybdenum, and the acid component was largely provided by the zeolite, gamma alumina, and silica/alumina. The catalyst had a total of 69.4 micromoles of acid sites per gram of catalyst at 400° C. as measured by the above ammonia adsorption/TGA method, after calcination of the catalyst to 500° C.

Samples of pyrolysis tar PT-1 were treated in the presence of hydrogen over the above described acidic catalyst in the flow reactor of Example I, at similar conditions as in Example I. The reaction temperature was about 550° F. (290° C.), the liquid space velocity of the pyrolysis tar was about 1.5 $hour^{-1}$ and the pressure was about 1000 psig (6.89 megapascals gauge). Hydrogen was supplied to the reactor at the same rate as in Example I. Hydrogen was produced at a rate of 230 scf/bbl. (41 cubic meters of hydrogen per cubic meter of tar feed) Samples of treated pyrolysis tar were coked in a laboratory batch coker at 100 psig (0.69 megapascals gauge) and made into electrodes by the above standard procedure. For the untreated and treated tar, the coke yield and the CTE of the electrodes were measured. The results are summarized below in Table D.

TABLE D

| | Pyrolysis Tar Treatment With Acidic/Hydrogenation Catalyst | |
|---|---|---|
| Tar | Coke Yield % | CTE ($\times 10^{-6}$/°C.) |
| Untreated | 35.6 | 0.61 |
| Treated | 29.6 | 0.53 |

As seen by the above results, the pyrolysis tar, which did not produce a premium coke (as shown by the CTE), was upgraded to a tar forming a premium coke. This was accomplished with a lowering or loss in coke yield (17%) that is significantly lower than the loss of coke yield in Example I (42%). Furthermore, there was a net hydrogen production, which also contrasts sharply with the prior-art process of Example I wherein a hydrogenation catalyst with no or negligible acid activity was used.

EXAMPLE III

This is a comparative example that does not illustrate the invention, but shows use of a low acidic hydrogenation catalyst. The comparative test of Example I was repeated, using the same low acidic hydrogenation catalyst, but using another a pyrolysis tar that produced in an untreated condition a lower quality coke (larger CTE) than the pyrolysis tar of Example I.

The properties of the pyrolysis tar used in this example (Pyrolysis Tar PT-2) are shown in Table E.

TABLE E

| Properties Of Pyrolysis Tar PT-2 | |
|---|---|
| Gravity, °API | 0.1 |
| Average Mol. Wt. | 315.0 |
| Sulfur, Wt. % | 0.85 |
| Carbon, Wt. % | 91.4 |
| Hydrogen, Wt. % | 7.4 |
| Conradson Carbon, Wt. % | 17.0 |
| Initial Boiling Point, °C. | 200.0 |
| 50% Boiling Point, °C. | 390.0 |

The pyrolysis tar was treated with hydrogen over the catalyst of Example I under the same conditions described in Example I. Hydrogen consumption was 600 scf/bbl. (107 cubic meters of hydrogen per cubic meter of tar feed).

For both the treated and untreated tar, the coke yield and the CTE of the electrodes made from the coke were measured. The results are summarized below in Table F.

TABLE F

| | Treatment With Hydrogenation Catalyst | |
|---|---|---|
| Tar | Coke Yield (%) | CTE ($10^{-6}$/°C.) |
| Untreated | 31.7 | 0.71 |
| Treated | 19.0 | 0.50 |

As seen in the above results, the pyrolysis tar was upgraded, but only at the cost of high hydrogen consumption, as compared with the practice of this invention in Example IV.

EXAMPLE IV

This example illustrates practice of the invention. The test of Example II was repeated using the same catalyst of Example II, except pyrolysis tar PT-2 of Example III was treated. The conditions of the test were the same as Example II, except that the temperature was about 630° F. (339° C.) as compared to 550° F. (290° C.) in Example II. The hydrogen consumption was only 75 scf/bbl (13 cubic meters hydrogen per cubic meter tar feed). Below in Table G are summarized the results of the test.

TABLE G

| | Treatment Using Acidic/Hydrogenation Catalyst | |
|---|---|---|
| Tar | Coke Yield (%) | CTE ($\times 10^{-6}$/°C.) |
| Untreated | 31.7 | 0.71 |
| treated | 20.5 | 0.49 |

By comparing the results of this Example with comparative Example III, the advantages gained by practice of the invention are seen. Although the pyrolysis tar was upgraded in both cases, the upgrading by the prior art-type process of Example III was achieved at a cost of a high hydrogen consumption of 600 scf/bbl (107 cubic meter hydrogen per cubic meter tar feed). This compares with the practice of the invention, wherein only 75 scf of hydrogen/bbl (13 cubic meters hydrogen per cubic meter of tar feed) were consumed. The coke yield was slightly improved. As shown in Example II, the coke yield can be significantly improved, while achieving a net hydrogen production.

EXAMPLE V

This is a comparative example showing treatment of the pyrolysis tar in the presence of hydrogen and no catalyst. Pyrolysis Tar PT-1 from Example I was treated as in Example I, except only the inert quartz chips with no catalyst were used in the reactor. The temperature was 700° F. (371° C.). The pressure and the space velocity of the pyrolysis tar was the same as in Example I. Hydrogen was produced at a rate of 400 scf/bbl (71 cubic meters of hydrogen per cubic meter of tar feed). For both the treated and untreated tar, the coke yield and the CTE of the electrodes made from the coke were measured. The results are summarized below in Table H.

TABLE H

| | Treatment With No Catalyst | |
|---|---|---|
| Tar | Coke Yield (%) | CTE ($\times 10^{-6}$/°C.) |
| Untreated | 31.5 | 0.61 |
| Treated | 31.8 | 0.79 |

The CTE for the coke from the treated tar as shown in Table H compares with a CTE of $0.53\times10^{-6}$/°C. for the same pyrolysis tar treated in the presence of a catalyst according to the invention in Example II. The pyrolysis tar here was actually down-graded such that it produced an unacceptable non-premium coke.

Although the invention has been described by reference to specific examples, it is understood that variations and alterations are within the spirit of the invention and they are contemplated as being included within the scope of the claims.

What is claimed is:

1. A method for upgrading a pyrolysis tar used to form coke which comprises hydrotreating a pyrolysis tar feed in the presence of a catalyst having a hydrogenation component and an acidic component provided by crystalline alumino-silicate, noncrystalline alumino-silicate, acidic alumina, sulfated zirconia, steam activated alumina, or steam activated alumino-silicate, wherein the catalyst has at least about 65 micromoles of acid sites per gram of the catalyst, wherein the acid sites per gram are measured by the ammonia adsorption/TGA method at about 400° C. after calcination of the catalyst to 500° C.; and producing hydrogen while hydrotreating the pyrolysis tar feed.

2. The method of claim 1 wherein the hydrogenation component is provided by a metal, salt, oxide, or sulfide of a Group VIII or VI-B metal.

3. The method of claim 1 wherein the hydrogenation component is provided by molybdenum, cobalt, platinum, or sulfided nickel.

4. The method of claim 1 wherein the hydrotreated pyrolysis tar is capable of forming a premium coke when subjected to destructive distillation conditions.

5. The method of claim 1 wherein the hydrotreatment is carried out at a pressure between about 3.4 and about 13.8 megapascals, and at a temperature between about 260° C. and about 425° C.

6. The method of claim 1 wherein the hydrotreatment is carried out at a pressure between about 3.4 and about 13.8 megapascals, and at a temperature is between about 290° C. and about 370° C.

7. A method for producing premium coke, which comprises (a) hydrotreating a pyrolysis tar feed in the presence of a catalyst having a hydrogenation component and an acidic component provided by crystalline alumino-silicate, noncrystalline alumino-silicate, acidic alumina, sulfated zirconia, steam activated alumina, or steam activated alumino-silicate, wherein the catalyst has at least about 65 micromoles of acid sites per gram of catalyst, wherein the acid sites per gram are measured by the ammonia adsorption/TGA method at about 400° C. after calcination of the catalyst to 500° C.; (b) producing hydrogen while hydrotreating the pyrolysis tar feed; and (c) subjecting the hydrotreated pyrolysis tar to destructive distillation conditions to form a coke.

8. The method of claim 7 wherein the hydrogenation component is provided by a metal, salt, oxide or sulfide of a Group VIII or VI-B metal.

9. The method of claim 7 wherein the hydrogenation component is provided by molybdenum, cobalt, platinum, or sulfided nickel.

10. The method of claim 7 wherein the pressure in step (a) is between about 3.4 and about 13.8 megapascals, and the temperature in step (a) is between about 260° C. and about 425° C.

11. The method of claim 7 wherein the pressure in step (a) is between about 3.4 and about 13.8 megapascals, and the temperature in step (a) is between about 290° C. and about 370° C.

12. The method of claim 1 wherein the acidic component is provided by LZ-10.

13. The method of claim 7 wherein the acidic component is provided by LZ-10.

14. A method for upgrading a pyrolysis tar used to form coke which comprises hydrotreating a pyrolysis tar feed in the presence of a catalyst having a hydrogenation component and an acidic component provided by crystalline alumino-silicate, noncrystalline alumino-silicate, acidic alumina, sulfated zirconia, steam activated alumina, or steam activated alumino-silicate, wherein the catalyst has at least about 65 micromoles of acid sites per gram of the catalyst, wherein the acid sites per gram are measured by the ammonia adsorption/TGA method at about 400° C. after calcination of the catalyst to 500° C.

15. A method for producing premium coke, which comprises (a) hydrotreating a pyrolysis tar feed in the presence of a catalyst having a hydrogenation component and an acidic component provided by crystalline alumino-silicate, noncrystalline alumino-silicate, acidic alumina, sulfated zirconia, steam activated alumina, or steam activated alumino-silicate, wherein the catalyst has at least about 65 micromoles of acid sites per gram of catalyst, wherein the acid sites per gram are measured by the ammonia adsorption/TGA method at about 400° C. after calcination of the catalyst to 500° C.; and (b) subjecting the hydrotreated pyrolysis tar to destructive distillation conditions to form a coke.

* * * * *